United States Patent [19]

Spiess et al.

[11] Patent Number: 4,904,120

[45] Date of Patent: Feb. 27, 1990

[54] FRAME FOR FORMING COVERINGS ON GROUND OPENINGS

[75] Inventors: Hansruedi Spiess, Delemont; Francois Galvanetto, Alle, both of Switzerland

[73] Assignee: Von Roll AG, Gerlafingen, Switzerland

[21] Appl. No.: 250,341

[22] Filed: Sep. 28, 1988

[30] Foreign Application Priority Data

Oct. 12, 1987 [CH] Switzerland ..... 3976/87

[51] Int. Cl.[4] ..... E02D 3/00

[52] U.S. Cl. ..... 405/258; 404/25; 405/303

[58] Field of Search ..... 405/258, 153, 303; 52/19, 20; 404/5, 25, 26

[56] References Cited

U.S. PATENT DOCUMENTS

| | | | |
|---|---|---|---|
| 935,376 | 9/1909 | Lennon | 405/153 X |
| 1,779,275 | 10/1930 | Humphryes | 405/153 |
| 2,323,906 | 7/1943 | Harm | 405/153 |
| 2,392,835 | 1/1946 | Conlon | 52/19 |
| 3,601,995 | 8/1971 | Seiz | 405/153 |
| 3,974,599 | 8/1976 | Grosh | 52/20 |
| 4,582,450 | 4/1986 | Neil | 404/26 |
| 4,637,752 | 1/1987 | Centa | 52/19 X |

*Primary Examiner*—Dennis L. Taylor

*Attorney, Agent, or Firm*—Helfgott & Karas

[57] ABSTRACT

A frame for forming coverings for ground openings and method of assembling such frame are disclosed. Frame parts for assembling the frame are provided at their ends with connecting lugs, which are arranged at different levels. On fitting the frame, the two frame parts are juxtaposed, their connecting lugs are arranged in spaced superimposed manner and are interconnected by screw couplings. For positively interconnecting the frame parts, the frame is turned upside down, and a liquid, pasty or granular filling material is filled into a bore on the underside of the upper connecting lug. The filling material also flows into the bore of the screw coupling, which is covered by a washer. Following the solidification of the filling material, the frame can either be transported in this state or in a disassembled state and can be then reassembled in the same way.

15 Claims, 2 Drawing Sheets

FRAME FOR FORMING COVERINGS ON GROUND OPENINGS

BACKGROUND OF THE INVENTION

The invention relates to a frame for forming coverings for ground openings constructed for receiving one or more juxtaposed covers or gratings and assembled from several frame parts provided with a frame base and a frame wall and which are interconnected by a screw coupling for forming the frame.

Coverings, in which one or more covers or gratings are inserted in a frame are known in numerous different forms. Such coverings are used for covering ground openings of all types, e.g., for covering manholes and openings in the floors and stories of buildings, such as warehouses, workshop halls and the like, so that it is possible to walk or drive over them and also easily open them.

In known constructions (Swiss Patent 313,512 and British Patent 2,134,572), the frame comprises several frame parts. These frame parts are butted together and screwed together at the abutment points, so that they then form a closed frame. The frame is then laid flush in the ground. For this purpose, the frame parts have a frame wall, whose upper edge is flush with the ground and a frame base, which serves as a support for a cover or a grating, which is used for covering the ground opening.

The use of individual frame parts makes it possible not only to form a frame for a single cover or grating, but also frames for receiving two or more covers or gratings enabling the covering of larger ground openings.

However, it is disadvantageous in the known constructions that the expenditure for producing such coverings is relatively high, because the abutment points of the frame parts and the covers and gratings must be at least partly mechanically worked. This is due to the tolerances of the frame parts, covers and gratings produced almost exclusively in a casting process. These tolerances do not permit a completely satisfactory assembly, particularly when the frame parts are screwed together.

SUMMARY OF THE INVENTION

It is an object of the present invention to provide an improved frame of the aforementioned type.

It is another object of the invention to provide a frame for coverings, a simple and exact assembly of which can be carried out taking into account tolerances of the cover or grating, without requiring machining of the frame parts, covers or gratings.

According to the invention, these objects of the invention are attained by the frame, in which for receiving the screw couplings, are provided, at the ends of the frame parts, connecting lugs each having at least one bore for receiving the screw coupling projecting over the end of the frame wall, whereby a first connecting lug of said lugs provided at one end of the frame wall is positioned lower than a second connecting lug at the other end of the frame wall, in such a way that in the frame with two adjacent frame parts the connecting lugs are superimposed in spaced manner and interconnected by the screw coupling. This arrangement of the connecting lugs makes it possible to adapt the frame parts to the particular cover or grating used. It is appropriate for the first connecting lug to be spaced over the lower edge of the frame wall, because as a result there is a space for the housing of the nut of the screw coupling and same does not project over the bottom of the frame base. Similarly, the second connecting lug is positioned in spaced manner below the upper edge of the frame wall, so that the screw head of the screw coupling does not project over the upper edge of the frame wall.

The invention also relates to a method for producing a frame for the coverings for ground openings and the object thereof is to permit the optimum manufacture of the inventive frame. According to the invention the object is attained by the method, wherein the frame is assembled by applying frame parts to the covers or gratings used, and these are held together by screw couplings, the frame parts being positively interconnected by filling the cavities in the vicinity of the screw couplings and the connecting lugs with a filling material.

DETAILED DESCRIPTION OF THE PREFERRED EMBODIMENTS

Figure 1:
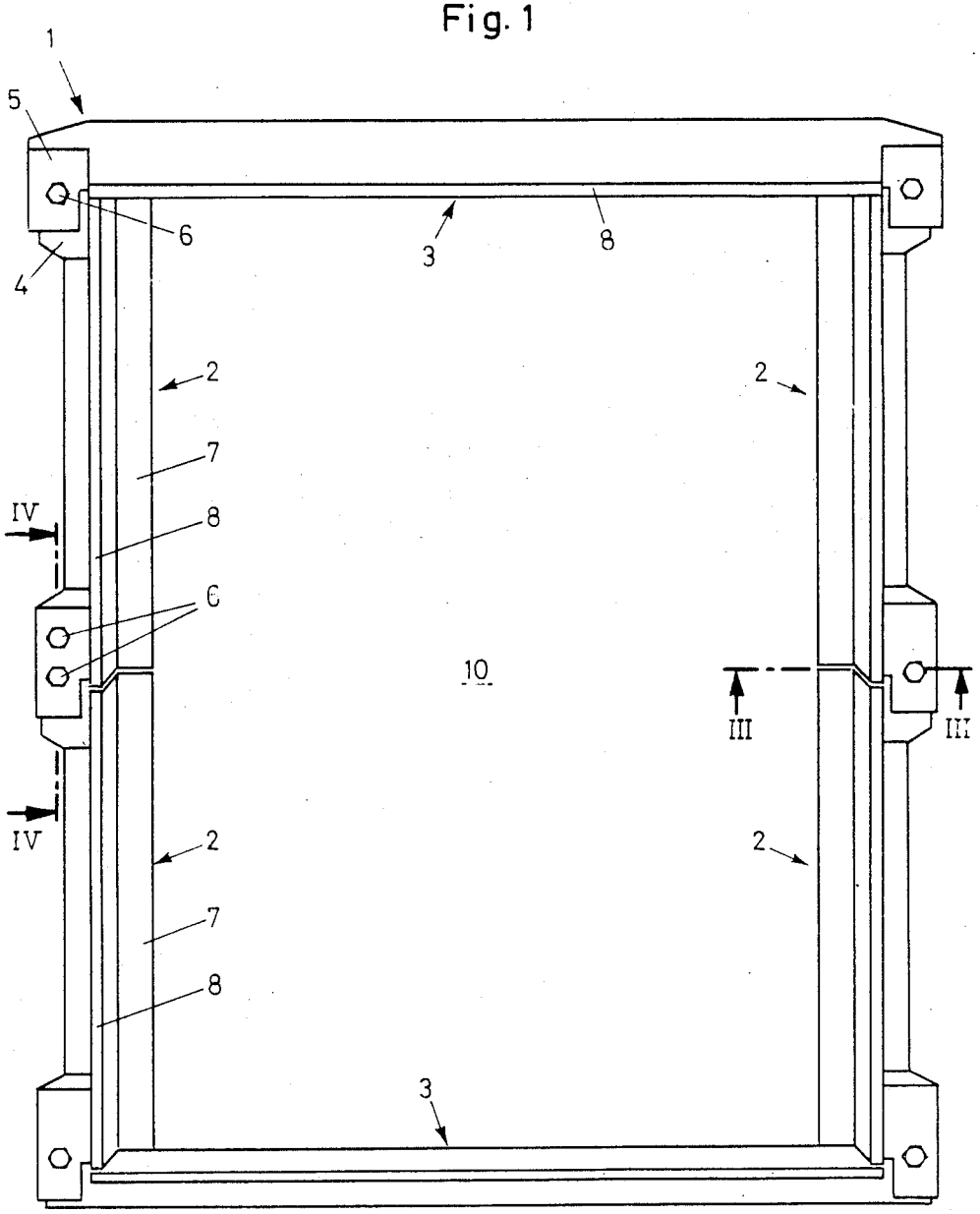
FIG. 1 is a top plan view of a frame assembled from frame parts.

FIG. 1 shows a frame 1, which comprises two pairs of frame parts 2, which are interconnected at their ends by cross-frame parts 3. For the interconnection of the frame parts and the cross-frame parts 3, are provided connecting lugs 4, 5, which are arranged on the frame external side and are superimposed. The connecting lugs, 4, 5 each have a bore 6 or two bores 6, as can be gathered from the left-hand side of FIG. 1. There can be a random number of bores.

Each frame part has at its one end a lower connecting lug 4 and at its other end an upper connecting lug 5. The cross-frame part could also be provided at its ends in each case with a lower and a higher connecting lug 4, 5. However, in FIG. 1 one cross-frame part is provided with upper connecting lugs 5 at both ends, whilst the other cross-frame part 3 is provided with lower connecting lugs. Unlike in the case of the cross-frame parts 3, frame parts z have a frame base 7, which extends from the interior of frame part z to its outside. A frame wall s on frame parts 2 and cross-frame part 3 defines the inner area 10 of frame 1. Corresponding to the two frame parts on each side of frame 1, it is also possible to provide two, not shown covers or gratings, which have the same extension as frame part 2. It is also possible to use covers or gratings of different size. It is obviously possible to construct frames with more than two frame part pairs. It is possible to use on each side a random number of frame parts and the number of covers or gratings as is necessary for covering the opening formed by the frame parts 2, 3.

Figure 2:
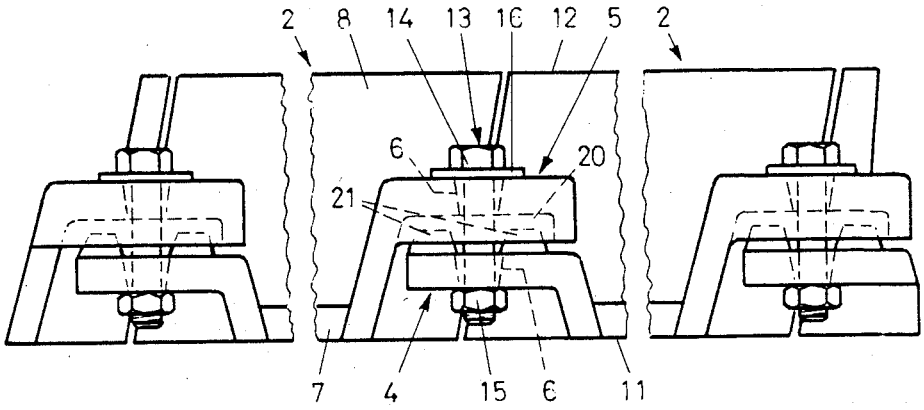
FIG. 2 is a side view of the frame according to FIG. 1, on a larger scale.

FIG. 2 shows the arrangement of the connecting lugs 4, 5. FIG. 2 shows two complete frame parts, i.e., with both ends and the ends of two further frame parts connected thereto.

The connecting lugs 4, 5 are superimposed, the lower connecting lug 4 being positioned spaced above a bottom 11 of the frame base 7 and the upper connecting lug 5 is positioned below the upper edge 12 of the frame wall 8.

The two connecting lugs 4, 5 are connected to each other by a screw coupling 13, which comprises a threaded bolt 14, a nut 15 and a washer 16. As can be gathered from FIG. 2, bores 6 are formed conically in both connecting lugs. Moreover, the upper connecting lug 5 has a cavity 20 formed in its underside, whilst on the top of the lower connecting lug 4 are provided two flat webs 21.

Figure 3:
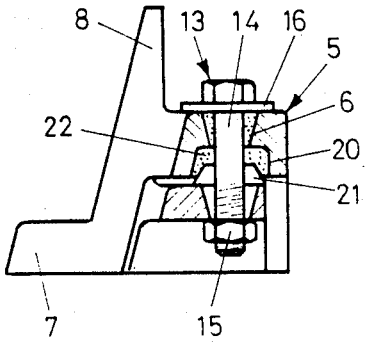
FIG. 3 is a section taken along line III—III in FIG. 1, on a larger scale.

FIG. 3 is a section through the bores 6 of the connecting lugs 4, 5. The same references are used in FIGS. 2 and 3 for designating the same parts. The representation according to FIG. 3 corresponds to the fitted frame. A positive connection is formed by inserting a filling material 22 into cavity 20 and into the bore 6 of the upper connecting lug 5. The filling material 22 can be molten aluminum, lead or a synthetic material in liquid, pasty or granular state. Filling takes place in that the frame parts are turned upside down, as will be explained in greater detail hereinafter.

Figure 4:
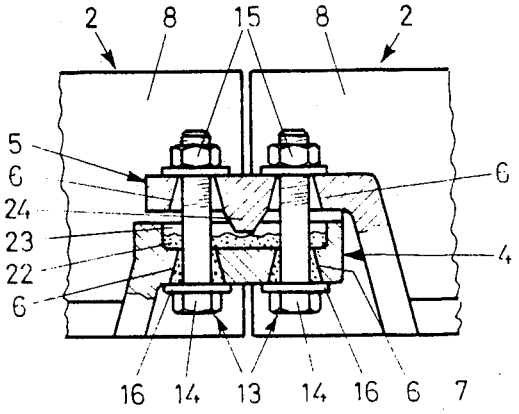
FIG. 4 a section taken along line IV—IV of FIG. 1 of another construction of the connection between two frame parts by means of connecting lugs, on a larger scale.

FIG. 4 shows a similar connection between two frame parts with the connecting lugs 4, 5 thereof, whereby in this case use is made of two bores 6 and correspondingly two screw couplings 13. Another difference is that here the lower connecting lug 4 has on its top surface a cavity 23, whilst the upper connecting lug 5 has on its bottom surface a web 24. The positive connection of the two connecting lugs 4, 5 is achieved in that the filling material 22 is filled into cavity 23 and bores 6 of the lower connecting lug, where it solidifies.

The fitting of the frame according to FIG. 3 takes place in the following way. The cover or grating or jig and the frame parts 2, 3 are turned upside down on an assembly substrate and the frame parts 2 are screwed together at their connecting lugs 4, 5. When the cover or grating or the jig and the frame parts 2 are aligned, the filling of the filling material 22 into cavity 20 and bore 6 of the upper connecting lug 5 takes place. When the filling material 22 is solidified, the frame can be broken down into its individual parts by loosening nuts 15, if this is e.g. necessary for transportation purposes. At the construction site, the frame can be reassembled in the same way as for the introduction of filling material 22. The conical construction of bore 6 improves the connection of the threaded bolts 14 and the frame parts z and facilitates the removal of the threaded bolt if this should be necessary for any reason.

The fitting of the frame according to FIG. 4 takes place as follows. In this case there is no need to turn the parts upside down. The frame is formed by erecting the frame parts 2, 3, by inserting the cover or grating of jig and by screwing the frame parts using the screw couplings 13. The filling material 22 is now introduced into the cavity 23 of the lower connecting lug 4, which also flows into the conical bores 6 of he lower connecting lug 4, Which are closed by washers 16. If following the solidification of the filling material 22 no disassembly of the frame is necessary, it is also possible to fit the screw couplings 13 in the opposite way, i.e., With the nut 15 at the bottom.

The described frame 1 has the important advantage that the parts of the frame and the grates or covers can be installed without mechanical working. Despite this a clean storage of the grates and covers is ensured and also the clearance thereof in the inner area 10 of the frame can be adapted to the dimensions of the cover or grating. The frame acquires stability through the introduction of a filling material 22.

What is claimed is:

1. A frame for forming coverings for ground openings and formed for receiving one or more juxtaposed covers or gratings, the frame comprising a plurality of frame parts each including a frame wall and a frame base; a plurality of screw couplings connecting said frame parts to each other for forming said frame, each of said frame parts including connecting lugs for receiving the screw couplings, said lugs being provided at ends of the frame parts and being formed each with at least one bore for receiving the screw coupling projecting over an end of the frame wall, a first connecting lug of said lugs provided at one end of the frame wall being positioned below a second connecting lug provided at another end of the frame wall in such a way that in the frame assembled of two adjacent frame parts the connecting lugs superimpose one another, are spaced from one another, extend parallel with each other and are connected to each other in spaced relationship by the screw coupling, one of said lugs having at a side thereof facing another of said lugs a cavity and another of said lugs having at least one web at a side thereof facing said one lug; and a solidifiable filling material filling said cavity and surrounding said web and a bolt of said screw coupling received in said bore of each lug for positively fixing said lugs with said screw couplings when said material is solidified.

2. Frame according to claim 1, wherein the first connecting lug is spaced from a lower edge of the frame wall and positioned above said lower edge.

3. Frame according to claim 1, wherein the second connecting lug is positioned below an upper edge of the frame wall and is spaced therefrom.

4. Frame according to claim 2, wherein the second connecting lug is positioned below an upper edge of the frame wall and is spaced therefrom.

5. Frame according to claim 2, wherein the first connecting lug has on a top surface thereof said web alongside of which is located said bore.

6. Frame according to claim 3, wherein the second connecting lug has said cavity on an underside thereof.

7. Frame according to claim 2, wherein the first connecting lug has said cavity on a top surface thereof.

8. Frame according to claim 3, wherein the second connecting lug has said web on an underside thereof alongside of which is arranged the bore.

9. Frame according to claim 1, wherein the bores in said lugs are frustum-conical-shaped.

10. Method for the manufacture of a frame for forming coverings for ground openings, comprising the steps of providing on said frame parts connecting lugs each formed with at least one bore, assembling the frame of frame parts so that a lug of one frame part is placed in superposed, parallel and spaced-apart position relative to a lug of another frame part, holding said frame parts together by inserting screw couplings into said superposed lugs, and positively connecting the frame parts to each other by filling cavities provided therein in the vicinity of the screw couplings and the bores of the connecting lugs with a solidifiable filling material.

11. Method according to claim 10, wherein the frame parts with the grating or cover or jig thereon are turned upside down, screwed together by the screw couplings and the filling material in liquid, pasty or granular state is fed into a cavity of an upper connecting lug of one of the frame parts and is allowed to solidify, the filling material also filling conical bores of said upper connecting lug.

12. Method according to claim 10, wherein the frame parts and the covers or gratings are assembled in a normal position or in a jig and are then screwed together by the screw couplings, then a cavity in a top or a lower connecting lug of one of the frame parts is filled with a liquid, pasty or granular filling material, and also conical bores of the upper connecting lug are filled with said filling material.

13. Frame according to claim 1, wherein said filling material also fills the bore of said one of said lugs.

14. Frame according to claim 13, wherein each screw coupling includes a washer placed against said bore to prevent loss of filling material during solidification thereof.

15. Frame according to claim 1, wherein two webs spaced from each other are provided on said another lug.

* * * * *